US008182308B2

(12) United States Patent
Payne

(10) Patent No.: US 8,182,308 B2
(45) Date of Patent: May 22, 2012

(54) TOY HAVING WATER SPRAY

(75) Inventor: Julian R. Payne, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 215 days.

(21) Appl. No.: 12/766,427

(22) Filed: Apr. 23, 2010

(65) Prior Publication Data

US 2010/0330868 A1 Dec. 30, 2010

Related U.S. Application Data

(60) Provisional application No. 61/214,773, filed on Jun. 29, 2009.

(51) Int. Cl.
*A63H 33/00* (2006.01)
*A63H 18/02* (2006.01)

(52) U.S. Cl. ..... 446/267; 446/268; 446/444; 446/475

(58) Field of Classification Search ..... 446/153, 446/156, 157, 173, 174, 267, 429, 430, 433, 446/435, 444, 445, 448, 473
See application file for complete search history.

(56) References Cited

U.S. PATENT DOCUMENTS 4,223,894 A * 9/1980 Fabricant ..... 273/349
4,689,032 A * 8/1987 Trossman ..... 446/160
5,586,923 A * 12/1996 Hippely et al. ..... 446/14
7,537,509 B2 * 5/2009 Payne et al. ..... 446/444
7,618,302 B2 * 11/2009 Collins et al. ..... 446/174
2010/0273392 A1 * 10/2010 Nuttall ..... 446/153

* cited by examiner

*Primary Examiner* — Nini Legesse
(74) *Attorney, Agent, or Firm* — Cantor Colburn LLP

(57) ABSTRACT

A toy vehicle playset is disclosed herein the playset having: a vessel configured to define a receiving area; an object being located proximate to the vessel, the object having a pair of body portions configured for movement between a first position wherein the pair of body portions are next to each other and a second position wherein the pair of body portions are moved away from each other; first and second track segments disposed proximate to the vessel such that a gap is formed between the first and second track segments and across the vessel; a trigger disposed on the second track segment; a toy vehicle having a thermochromic paint thereon that is configured to travel along the first and second track segments, wherein the thermochromic paint on the toy vehicle changes from a first color to a second color in response to a temperature change of the thermochromic paint; wherein the pair of body portions are moved from the first position to the second position when the toy vehicle travels along the second track segment and actuates the trigger; and wherein the object has at least one spray nozzle fluidly coupled to a tank of fluid wherein a user operated pump sprays fluid from the tank towards the receiving area, the fluid being capable of changing the temperature of the thermochromic paint.

18 Claims, 4 Drawing Sheets

TOY HAVING WATER SPRAY

CROSS REFERENCE TO RELATED APPLICATIONS

This application claims the benefit of U.S. Provisional Patent Application 61/214,773 filed Jun. 29, 2009, the contents of which are incorporated herein by reference thereto.

BACKGROUND

This invention relates generally to toy vehicle playsets and more particularly to water play apparatus used in combination therewith.

Toy vehicle playsets having enjoyed extended popularity for many years among child users. The basic toy vehicle playset utilizes one or more track segments which are traversed by toy vehicles. Toy vehicles have been provided in unpowered free wheeling configurations as well as variously powered vehicles. In many toy vehicle playsets utilizing unpowered free-wheeling toy vehicles, some type of launcher or other apparatus is typically provided to impart energy to the toy vehicles. Additionally, toy vehicle playsets have utilized tracks having multiple ramps and loops as well as other entertainment features or jumps or the like.

In a related art, practitioners in the art have provided toy vehicles having color change paints on their outer surfaces. The majority of such color change paints responds to changes in temperature to produce their change in appearance. One of the most common types of temperature change inducing systems utilized in toy vehicle playsets involves emersion or spray of heated or cooled water.

Accordingly it is desirable to provide a playset with features that can spray heated or cooled fluids upon an object such that the color of the object will change.

SUMMARY OF THE INVENTION

In one exemplary embodiment a toy vehicle playset is disclosed herein. The playset having: a vessel configured to define a receiving area; an object being located proximate to the vessel, the object having a pair of body portions configured for movement between a first position wherein the pair of body portions are next to each other and a second position wherein the pair of body portions are moved away from each other; first and second track segments disposed proximate to the vessel such that a gap is formed between the first and second track segments and across the vessel; a trigger disposed on the second track segment; a toy vehicle having a thermochromic paint thereon that is configured to travel along the first and second track segments, wherein the thermochromic paint on the toy vehicle changes from a first color to a second color in response to a temperature change of the thermochromic paint; wherein the pair of body portions are moved from the first position to the second position when the toy vehicle travels along the second track segment and actuates the trigger; and wherein the object has at least one spray nozzle fluidly coupled to a tank of fluid wherein a user operated pump sprays fluid from the tank towards the receiving area, the fluid being capable of changing the temperature of the thermochromic paint.

BRIEF DESCRIPTION OF THE DRAWINGS

Other features, advantages and details appear, by way of example only, in the following description of embodiments, the description referring to the drawings in which.

DETAILED DESCRIPTION

By way of overview and referring to the FIGS., the present invention provides a toy vehicle playset having a center obstacle wherein a toy vehicle catch basin or vessel is situated. An upwardly inclined launch ramp or first track segment is positioned on one side of the basin and a downwardly inclined landing ramp or second track segment is positioned on the opposite side creating a gap therebetween within which the catch basin or vessel is situated. A toy vehicle launcher and a toy vehicle water emersion tank are positioned in line with the launch ramp. A trigger is supported within the landing ramp for indicating the successful passage of a toy vehicle from the launch ramp to the landing ramp. A simulated obstacle which in one non-limiting embodiment is configured to resemble an attacking octopus is supported in proximity to the catch basin and includes a plurality of water spray tentacles. Of course, other types of creatures, animals, etc. whether real or fictitious. In one embodiment, a simulated head explosion is provided by mating portions of the octopus head supported by movement mechanism responsive to the trigger in the landing ramp.

In operation and in one embodiment, a toy vehicle is initially immersed in the water tank to effect a color change and thereafter the toy vehicle is positioned in the launch position. The launcher is then activated to send the toy vehicle upwardly the launch ramp and attempt to traverse the gap to the landing ramp. In the event the toy vehicle successfully traverses the gap and impacts the landing ramp, the trigger sensor therein causes a simulated head explosion to occur in the octopus obstacle. In the event the toy vehicle does not traverse the gap, it descends into the catch basin and is sprayed with water from the octopus tentacles. The water sprayed is of an appropriate temperature to cause a color change in the vehicle. For example, the sprayed water can be cooler than the water in the tank near the launcher or the vehicle is not initially immersed in the tank near the launcher or in still another variation water sprayed is hotter than the water in the tank near the launcher.

Figure 1:
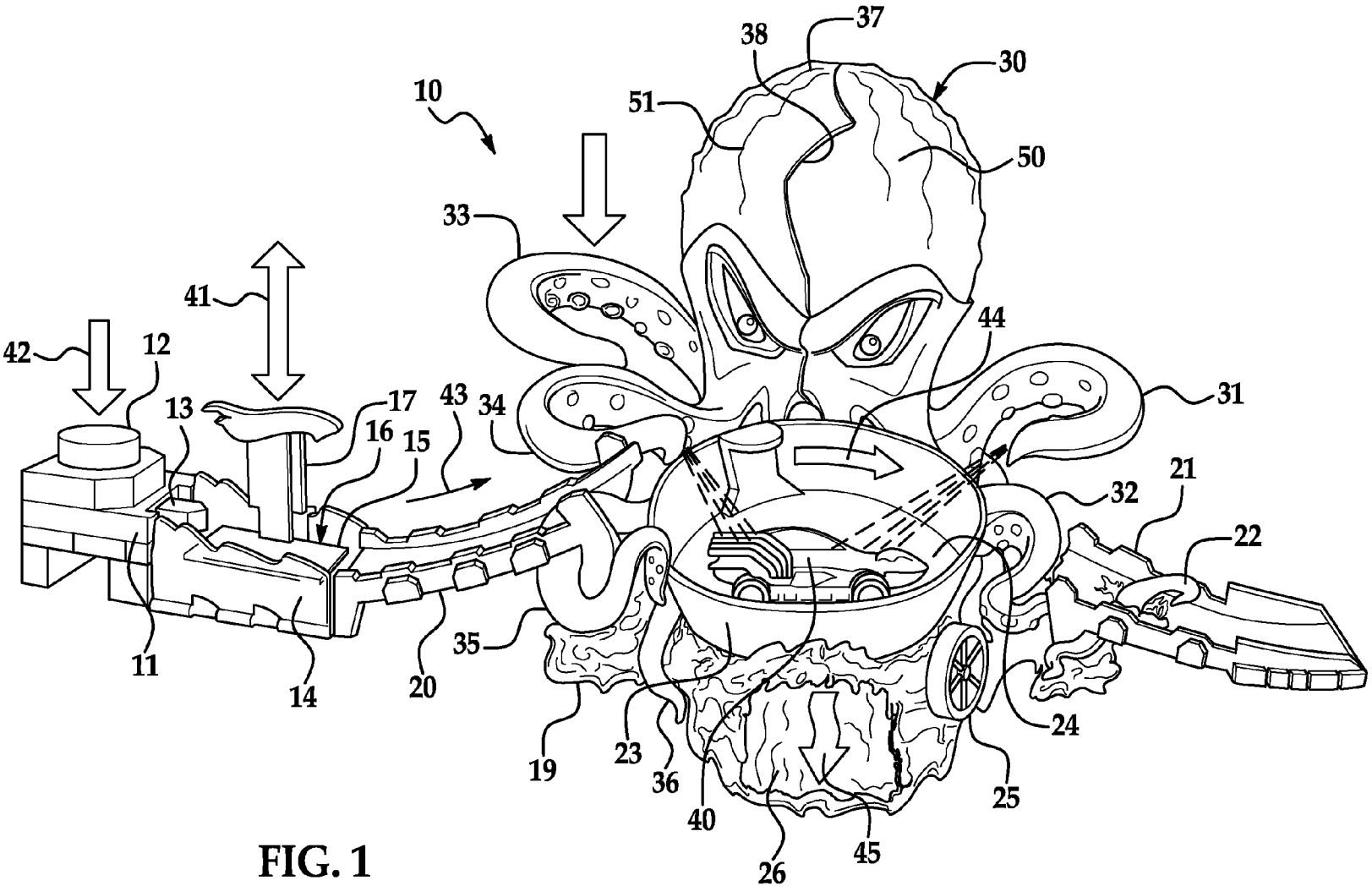
FIG. 1 sets forth a front perspective view of a toy vehicle playset constructed in accordance with an exemplary embodiment of the present invention in a first configuration.

More specifically, FIG. 1 sets forth a front perspective view of a toy vehicle playset constructed in accordance with the present invention and generally referenced by numeral 10. Toy vehicle playset 10 includes a toy vehicle launcher 11 having a depressible button 12 which activates a launch plunger 13. The launcher may be any type of manually or electrically activated launcher known to those skilled in the related arts. Launcher 11 further includes a water tank 14 having a reservoir 16 formed therein. Water tank 14 further supports a multi apertured grate 15 which is secured to a slider 17. Water tank 14 is joined to an upwardly inclined launch ramp 20 which is supported at its upper end by a base 19. Base 19 further supports a downwardly angled landing ramp 21 having a trigger 22 supported therein. In one embodiment, trigger 22 is fancifully shaped to resemble the end of an octopus tentacle of course, numerous other configurations are contemplated. Base 19 is fabricated to resemble of quantity of water or match a scene corresponding to the obstacle or object. A catch basin or vessel 23 rotatably mounted to the play set is located between the ramps or track segments. A floor grate 24 having a plurality of apertures is pivotally received within the basin or vessel 23. A knob 25 is rotatably supported upon base 19 and is coupled to a gear 90 configured to mesh with a feature 92 on the bottom of the basin such that rotation of the knob will rotate the gear and the basin such as indicated by arrow 44.

Toy vehicle playset 10 further includes an object or in one embodiment a simulated octopus 30 having a head 37 formed of half portions or pair of body portions 50 and 51 pivotally mounted to the playset for movement between a first position (FIG. 1) wherein the portions are joined at a crack 38 and a second position (FIG. 2) wherein they are separated from each other. The object or octopus 30 further includes a plurality of tentacles 31, 32, 33, 34, 35 and 36. Tentacles 31 and 34 are configured to provide water sprays directed at a receiving area of the catch basin or vessel 23.

In FIG. 1, a toy vehicle 40 is shown captured within catch basin 23 being subjected to water spray tentacles 31 and 34. In an exemplary embodiment, the toy vehicle such as toy vehicle 40 is preferably covered with a color change paint such as a thermochromic paint which responds to temperature differences by changing color or appearance. In one play pattern, the toy vehicle 40 is positioned within water tank 14 upon grate 15. Thereafter, the user presses slide 17 downwardly which lowers grate 15 immersing toy vehicle 40 into the water within reservoir 16 of tank 14. The emersion of toy vehicle 40 within the water of reservoir 16 changes the color of the toy vehicle. Thereafter, slider 17 is allowed to return to the raised position shown which in turn aligns toy vehicle 40 with plunger 13 of launcher 11. The user then depresses button 12 rapidly to extend launcher 13 and impart motion to the toy vehicle sending it upwardly upon ramp 20 in the direction indicated by arrow 43. The objective in launching toy vehicle 40 is to traverse the gap between track segments or ramps 20 and 21 and impact trigger 22. When trigger 22 is impacted, head 37 of octopus 30 undergoes a simulated explosion depicted in FIG. 2.

In the event toy vehicle 40 does not traverse the gap between ramps or track segments 20 and 21, it is captured in the receiving area of the catch basin or vessel 23 falling to the position shown in FIG. 1. When the toy vehicle impacts floor grate 24 of catch basin 23, the spray apparatus or pump driving water to the tentacles 31 and 34 causes toy vehicle 40 to be sprayed water at a temperature which induces color change. During the spray process, the user may rotate knob 25 to rotate the vessel or basin 23 and evenly change the color of toy vehicle 40. Of course, numerous patterns are contemplated wherein water of different temperatures can be used or the tank next to the launcher is not used.

Figure 2:
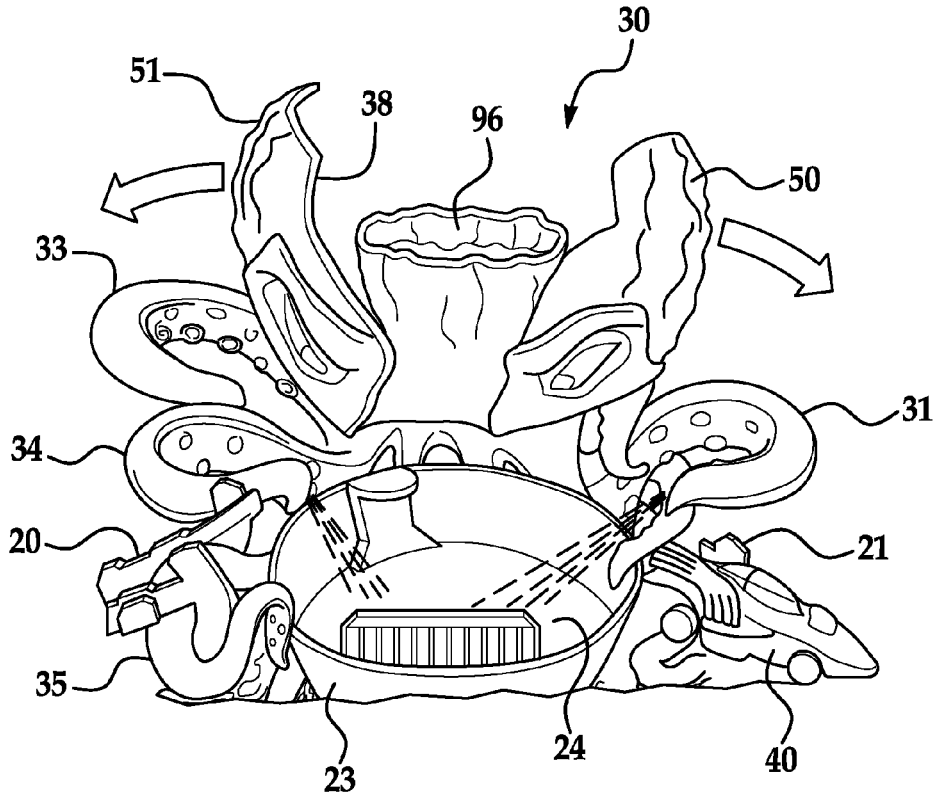
FIG. 2 sets forth a partial perspective view of an exemplary embodiment of the present invention in a second configuration.
Figure 5:
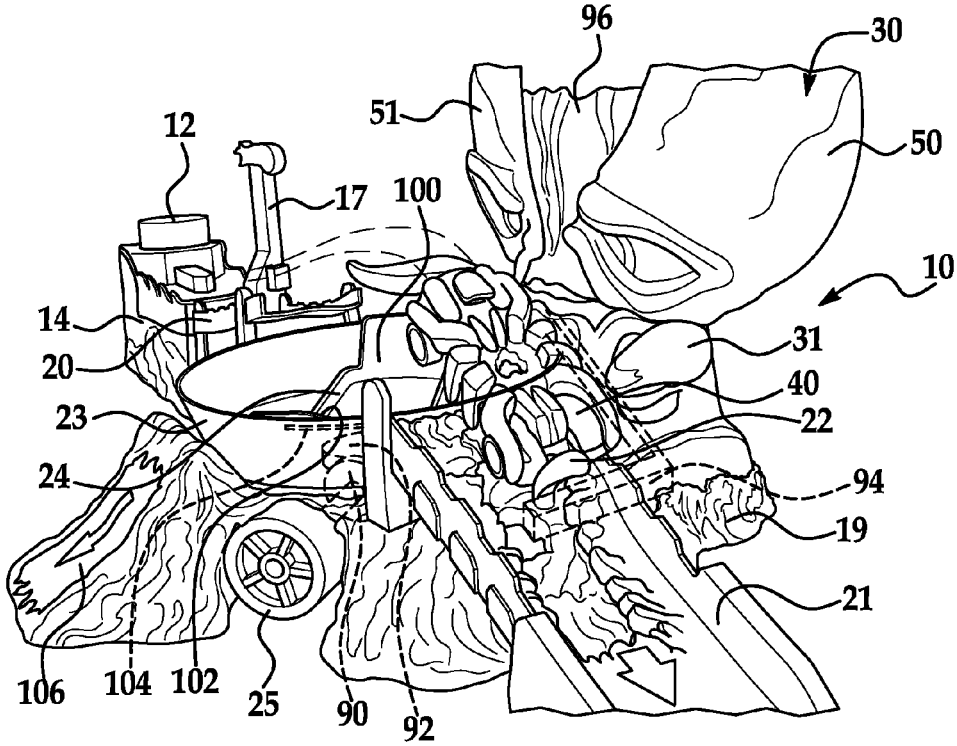
Figure 6:
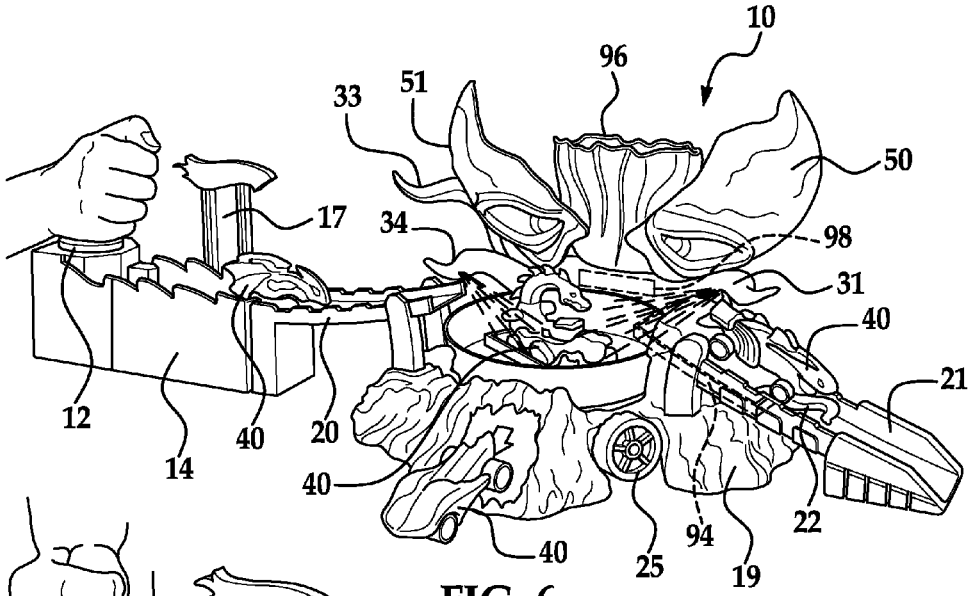
Figure 7:
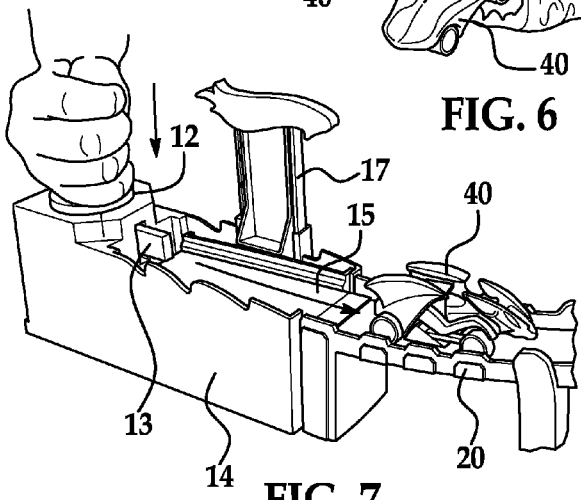
Figure 8:
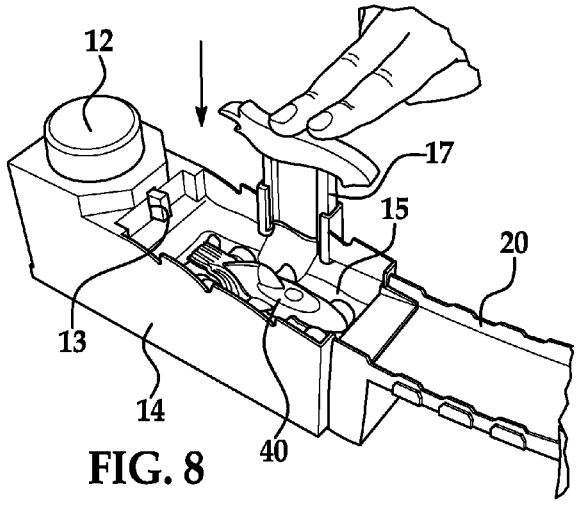

FIG. 2 sets forth a partial front perspective view showing the head explosion simulation of octopus 30. FIGS. 2, 5 and 6 depict the response of car 40 impacting trigger 22 upon ramp 21. With this triggering action, head portions 50 and 51 are allowed to pivot outwardly in the manner shown in FIGS. 2, 5 and 6 separating along crack 38.

Figure 4:
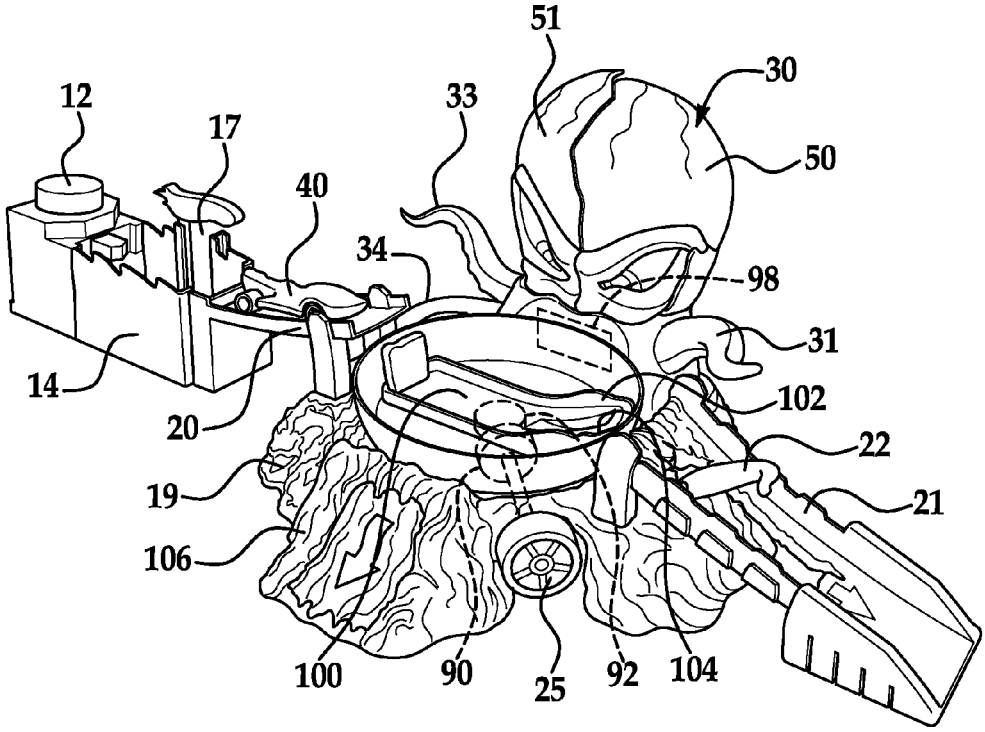
FIGS. 4-8 are additional views of an exemplary embodiment of the present invention.

FIGS. 1-2 and 4-7 also illustrate exemplary embodiments of the present invention wherein a vehicle playset 10 has a vessel configured to define a receiving area is disclosed. The object, creature or octopus 30 is located proximate to the vessel, the object having a pair of body portions 50, 51 configured for movement between a first position (FIGS. 1 and 4) wherein the pair of body portions are next to each other and a second position wherein the pair of body portions are moved away from each other (FIGS. 2, 4 and 5). First and second track segments 20 and 21 are disposed proximate to the vessel such that a gap is formed between the first and second track segments and across the vessel. A trigger 22 is disposed on the second track segment such that the pair of body portions are moved from the first position to the second position when the toy vehicle travels along the second track segment and actuates the trigger. The trigger being coupled to a linkage 94 that releases the pair of body portions when the trigger is actuated. In one non-limiting embodiment, the trigger is spring biased upwardly to a first position away from a surface of the track segment 21 such that it will be moved to a second position and manipulate the linkage 94 when it is hit by vehicle 40.

In addition, each body portion 50, 51 is spring biased into the second position (FIG. 1) and a distal end of the linkage engages a portion of the body portions 50, 51 to retain them in the first position until the linkage is actuated by the vehicle. Any suitable linkage known to those skilled in the related arts may be employed to retain the body portions in the first position until the trigger is manipulated. Accordingly, actuation of the trigger when the portions are in the first position will cause them to move to the second or deployed position.

Also shown in the FIGS. is that the object 30 has a tank of fluid or reservoir 96 fluidly coupled to spray nozzles 31 and 34 wherein a user operated pump 98 sprays fluid from the tank towards the receiving area and the user operated pump is manually operated by a lever 33 movably secured to the object. Any suitable pump manual or otherwise known to those skilled in the related arts may be employed to pump the fluid or water from the reservoir to the spray nozzles. In addition and in order to provide additional features, the spray nozzles are pivotally or movably mounted to the object so they may be repositioned to provide additional spray patterns.

Also shown in the FIGS. is that the vessel further comprises a grate 24 pivotally mounted to the vessel for movement between a first position wherein the grate is in the receiving area to a second position wherein the grate is moved out of the receiving area and the toy vehicle can roll out of the receiving area. In one embodiment, the grate is configured to have a receiving area 100 configured to receive the toy vehicle therein, the receiving area having a ramp portion 102 configured to allow the toy vehicle to roll out of the grate when it is pivoted up towards the second position by rotating about a hinge 104.

The toy vehicle playset also has a ramp 106 configured to receive the toy vehicle from the grate when the grate is in the second position and the ramp portion of the grate is aligned with the ramp portion of the playset.

Figure 3:
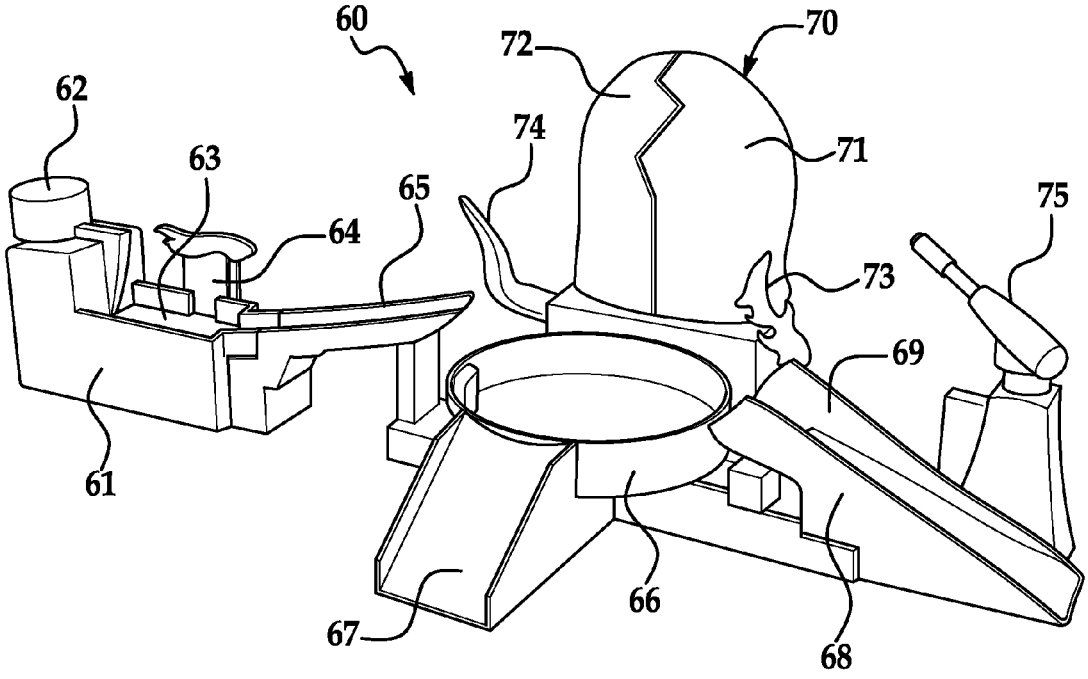
FIG. 3 sets forth a front perspective view of an alternate exemplary embodiment of the present invention.

FIG. 3 sets forth an alternative embodiment of the present invention toy vehicle playset utilizing a similar arrangement to the embodiment shown in FIG. 1. In this embodiment, a water spray cannon 75 is provided. Water spray cannon 75 may replace spray tentacles 31 and 34 or alternatively may be used in combination therewith.

More specifically, FIG. 3 sets forth a toy vehicle playset generally referenced by numeral 60. Toy vehicle playset 60 includes a launcher 61 having a water reservoir 63 therein. An emersion mechanism 64 similar to slide 17 and grate 15 of FIG. 1 is provided. A quantity of water within reservoir 63 is operative to produce color change for an immersed toy vehicle. Launcher 61 is operative in response to the user rapidly depressing button 62. Launcher 61 is coupled to an upwardly angled launch ramp 65. Toy playset 60 further includes a downwardly angled landing ramp 68 having a trigger sensor 69 supported therein. A water spray cannon 75 is supported above landing ramp 68.

A catch basin 66 having a drain 67 is supported between ramps 65 and 68. Toy vehicle playset 60 further includes a simulated octopus 70 having head portions 71 and 72 together with tentacles 73 and 74.

In operation, toy vehicle playset 60 is operative in substantial accordance with toy vehicle playset 10 shown in FIGS. 1 and 2. Accordingly, a toy vehicle is initially immersed in reservoir 63 to provide color change thereof. Thereafter, button 62 is rapidly depressed to launch the toy vehicle upwardly upon launch ramp 65. The toy vehicle then travels upwardly above catch basin 66 toward landing ramp 68. In the event the toy vehicle does not traverse the entire gap between ramps 65 and 68, it descends into catch basin 66 and is sprayed by a stream of water from water spray cannon 75. In the event the toy vehicle traverses the gap and impacts sensor 69 as it lands upon ramp 68, head portions 71 and 72 split outwardly in a similar action in that shown in FIG. 2 to indicate victory for the user.

What has been shown is a toy vehicle playset having a water spray feature in combination with toy vehicles coded with a thermochromic paint. As a result, the toy vehicle if unsuccessful in traversing the obstacles of the trackset is subjected to a water spray which causes a color change of the toy vehicle. In a novel play feature, the playset provides a head exploding simulation of an attacking octopus situated within the obstacle of the playset.

In one non-limiting exemplary embodiment, the toy vehicle playset provides a fanciful depiction of an octopus presenting an obstacle between two track set ramps which must be traversed by the toy vehicle. A launcher is provided for propelling the toy vehicle upwardly upon the first ramp which thereafter traverses a gap and lands upon the second ramp which is angled downwardly. Within the gap between the two ramps, a catch basin is positioned together with a fanciful depiction of an octopus poised for attack upon the vehicle attempting to traverse the gap. The octopus sprays cooling water upon the toy vehicle as it traverses the gap causing a color change. The catch basin between the ramps is also configured to receive a toy vehicle which is unsuccessful in traversing between the ramps. A tentacle-shaped trigger is positioned in the landing ramp to provide indication of successful passage of the toy vehicle across the gap and an operative mechanism coupled to the trigger to simulate a head splitting defeat response in the octopus.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A toy vehicle playset, comprising:

a vessel configured to define a receiving area;

an object being located proximate to the vessel, the object having a pair of body portions configured for movement between a first position wherein the pair of body portions are next to each other and a second position wherein the pair of body portions are moved away from each other;

first and second track segments disposed proximate to the vessel such that a gap is formed between the first and second track segments and across the vessel;

a trigger disposed on the second track segment;

a toy vehicle having a thermochromic paint thereon that is configured to travel along the first and second track segments, wherein the thermochromic paint on the toy vehicle changes from a first color to a second color in response to a temperature change of the thermochromic paint;

wherein the pair of body portions are moved from the first position to the second position when the toy vehicle travels along the second track segment and actuates the trigger; and wherein the object has at least one spray nozzle fluidly coupled to a tank of fluid wherein a user operated pump sprays fluid from the tank towards the receiving area, the fluid being capable of changing the temperature of the thermochromic paint.

2. The toy vehicle playset as in claim 1, further comprising a toy vehicle launcher configured to launch the toy vehicle along the first track segment towards the gap and the second track segment such that the toy vehicle either traverses the gap and lands on the second track segment or falls into the receiving area.

3. The toy vehicle playset as in claim 2, wherein a reservoir is positioned between the launcher and the first track segment and wherein the toy vehicle playset further comprises a lift for movement between a first position wherein the lift provides a path from the launcher to the first track segment and a second position wherein the lift is inserted into a tank of the reservoir, wherein the reservoir contains a fluid that can change the temperature of the thermochromic paint.

4. The toy vehicle playset as in claim 3, wherein the fluid is water.

5. The toy vehicle playset as in claim 2, wherein the vessel further comprises a grate pivotally mounted to the vessel for movement between a first position wherein the grate is in the receiving area to a second position wherein the grate is moved out of the receiving area and the toy vehicle can roll out of the receiving area.

6. The toy vehicle playset as in claim 5, wherein the playset further comprises a ramp configured to receive the toy vehicle from the grate when the grate is in the second position.

7. The toy vehicle playset as in claim 6, wherein the object has at least two spray nozzles fluidly coupled to the tank of water and wherein the user operated pump sprays the fluid from the at least two spray nozzles into the receiving area from opposite sides and wherein the pump is operated by a handle member extending from the object.

8. The toy vehicle playset as in claim 7, wherein the object is configured to resemble an octopus and the trigger, the at least two spray nozzles, the handle member each are configured to resemble a tentacle of the octopus.

9. The toy vehicle playset as in claim 8, wherein the pair of body portions resemble portions of a head of the octopus.

10. The toy vehicle playset as in claim 6, wherein the at least two spray nozzles are movably secured to the object to provide various spray patterns.

11. The toy vehicle playset as in claim 6, wherein the vessel is rotatably mounted to the playset and the playset further comprises a knob rotatably coupled to a gear configured to rotate the vessel.

12. The toy vehicle playset as in claim 5, wherein the grate is configured to have a receiving area configured to receive the toy vehicle therein, the receiving area having a ramp portion configured to allow the toy vehicle to roll out of the grate when it is in the second position.

13. The toy vehicle playset as in claim 1, wherein the pump is operated by a handle member extending from the object.

14. The toy vehicle playset as in claim 13, wherein the tank is located behind the pair of body portions when they are in the first position.

15. The toy vehicle playset as in claim 13, wherein the object has at least two spray nozzles fluidly coupled to the tank of water and wherein the user operated pump sprays the fluid from the at least two spray nozzles into the receiving area from opposite sides and wherein the pump is operated by a handle member extending from the object.

16. The toy vehicle playset as in claim 15, wherein the object is configured to resemble an octopus and the trigger, the at least two spray nozzles, the handle member each are configured to resemble a tentacle of the octopus.

17. The toy vehicle playset as in claim 15, wherein the at least two spray nozzles are movably secured to the object to provide various spray patterns.

18. The toy vehicle playset as in claim 15, wherein the vessel is rotatably mounted to the playset and the playset further comprises a knob rotatably coupled to a gear configured to rotate the vessel.

* * * * *